US007441281B2

(12) United States Patent
Salem

(10) Patent No.: US 7,441,281 B2
(45) Date of Patent: Oct. 28, 2008

(54) MULTI REVERSIBLE GARMENT

(76) Inventor: Tamara Salem, 20A Brener Street, Tel Aviv 63826 (IL)

( * ) Notice: Subject to any disclaimer, the term of this patent is extended or adjusted under 35 U.S.C. 154(b) by 448 days.

(21) Appl. No.: 10/652,691

(22) Filed: Aug. 29, 2003

(65) Prior Publication Data

US 2005/0044604 A1 Mar. 3, 2005

(51) Int. Cl.
*A41B 1/00* (2006.01)

(52) U.S. Cl. ..... 2/115; 2/DIG. 2

(58) Field of Classification Search ..... 2/69, 2/69.5, 72, 75, 77, 269, 80, 86, 113–115, 2/121–126, 133, 244, DIG. 2, 109, 114, 102
See application file for complete search history.

(56) References Cited

U.S. PATENT DOCUMENTS

| | | | | | |
|---|---|---|---|---|---|
| 1,084,970 | A | * | 1/1914 | Shakofsky | 2/74 |
| 1,695,590 | A | * | 12/1928 | Jensen | 2/74 |
| 2,263,544 | A | * | 11/1941 | Rosenstein | 2/90 |
| 2,275,694 | A | * | 3/1942 | Soboroff | 2/209.12 |
| 2,422,779 | A | * | 6/1947 | Fligel | 2/93 |
| 2,515,089 | A | * | 7/1950 | Kamhi | 2/211 |
| 2,711,539 | A | * | 6/1955 | Loscher | 2/93 |
| 2,890,460 | A | * | 6/1959 | Levi | 2/144 |
| 2,948,900 | A | * | 8/1960 | Ebenstein | 2/195.7 |
| 3,234,564 | A | * | 2/1966 | Chujfi | 2/227 |
| 3,296,628 | A | * | 1/1967 | Collins | 2/211 |
| 3,492,676 | A | * | 2/1970 | King | 2/114 |
| 3,574,237 | A | * | 4/1971 | Reynolds | 2/211 |
| 4,078,265 | A | * | 3/1978 | Condit | 2/115 |
| 4,296,498 | A | * | 10/1981 | Vinson | 2/115 |
| 4,472,835 | A | * | 9/1984 | Clark | 2/102 |
| 4,603,440 | A | * | 8/1986 | Hale | 2/115 |
| 4,797,954 | A | * | 1/1989 | Williams et al. | 2/106 |
| 5,029,344 | A | | 7/1991 | Shannon et al. | 2/69 |
| 5,159,718 | A | * | 11/1992 | Moyer | 2/69 |
| 5,204,995 | A | | 4/1993 | Knapp | 2/228 |
| 5,561,860 | A | * | 10/1996 | Nguyen-Senderowicz | 2/90 |
| 5,611,086 | A | * | 3/1997 | Eggen | 2/104 |
| 5,758,363 | A | * | 6/1998 | Winfree | 2/122 |
| 5,946,726 | A | * | 9/1999 | Green | 2/109 |
| 6,018,821 | A | * | 2/2000 | Adams | 2/209.11 |
| 6,059,633 | A | * | 5/2000 | Currier | 450/31 |
| 6,128,783 | A | * | 10/2000 | Blauer et al. | 2/90 |
| 6,182,296 | B1 | | 2/2001 | Hosogai | 2/227 |
| 6,282,717 | B1 | * | 9/2001 | Ng | 2/70 |
| 6,345,393 | B1 | | 2/2002 | Bayer | 2/94 |
| 6,550,066 | B1 | * | 4/2003 | Brassey | 2/93 |
| 2004/0064869 | A1 | * | 4/2004 | Deadwyler | 2/115 |
| 2004/0158911 | A1 | * | 8/2004 | Amnuel | 2/115 |

* cited by examiner

*Primary Examiner*—Alissa L Hoey
(74) *Attorney, Agent, or Firm*—Abelman, Frayne & Schwab

(57) ABSTRACT

A reversible garment including at least three body panels, which are joined together along at least two seams.

8 Claims, 16 Drawing Sheets

108
VIII
106
VI
104
IV
102
II
110
110
108
112
112
106
104
102

MULTI REVERSIBLE GARMENT

FIELD OF THE INVENTION

The present invention to reversible garments generally.

BACKGROUND OF THE INVENTION

The following U.S. Patents are believed to represent the current state of the art:

U.S. Pat. Nos. 5,029,344; 5,204,995; 6,182,296 and 6,345,393.

SUMMARY OF THE INVENTION

The present invention seeks to provide improved reversible garments.

There is thus provided in accordance with a preferred embodiment of the present invention a reversible garment including at least three body panels, which are joined together along at least two seams. Preferably, at least two of the at least three body panels have different cuts. Additionally, at least one of the at least three body panels has sides having differing appearances.

In accordance with another preferred embodiment of the present invention the garment is a top. Preferably, the at least three body panels are joined along side seams.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1A:
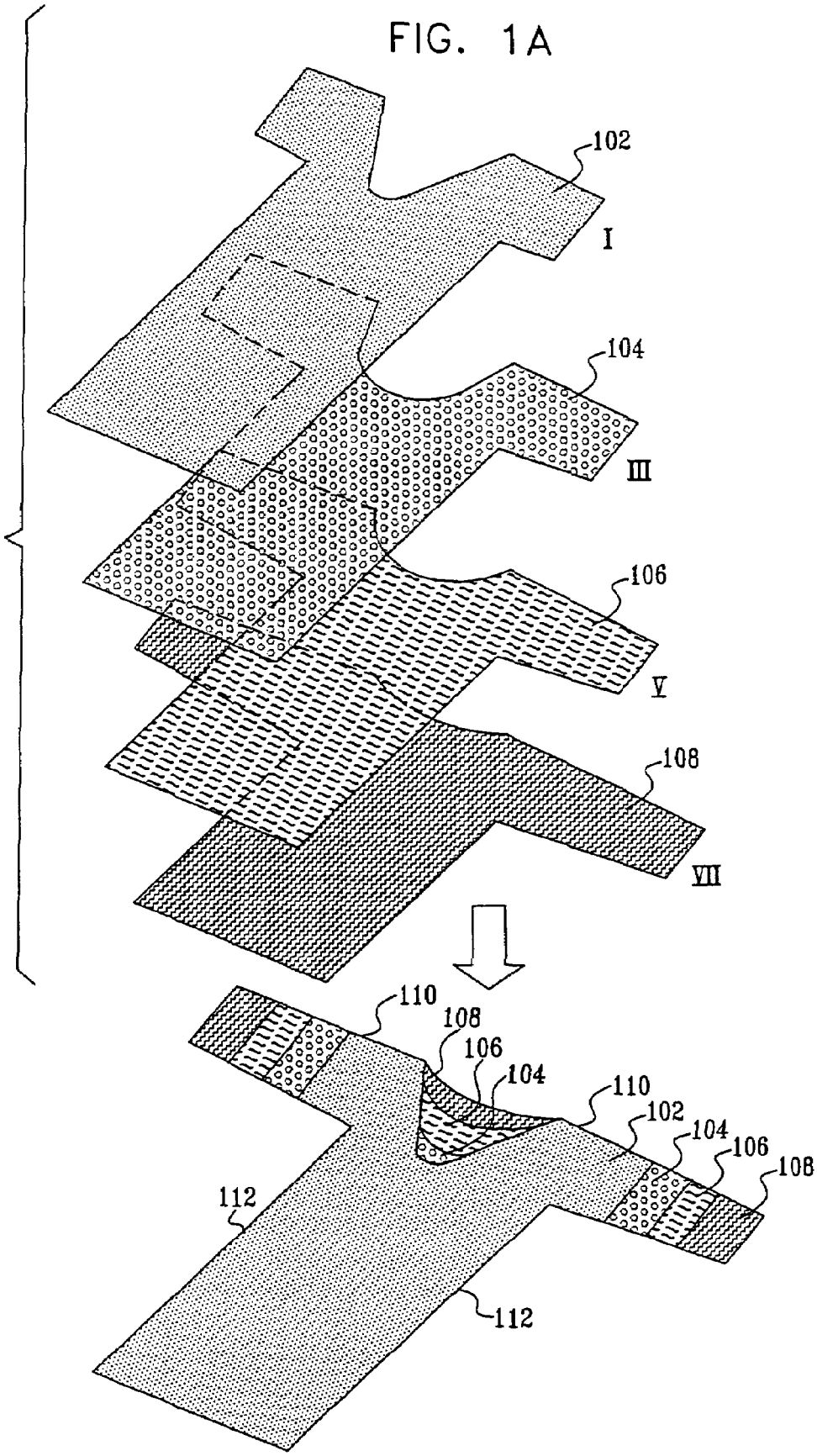
FIG. 1A is a diagrammatic illustration of the front of a garment and its constituent panels constructed and operative in accordance with a preferred embodiment of the present invention.
Figure 1B:
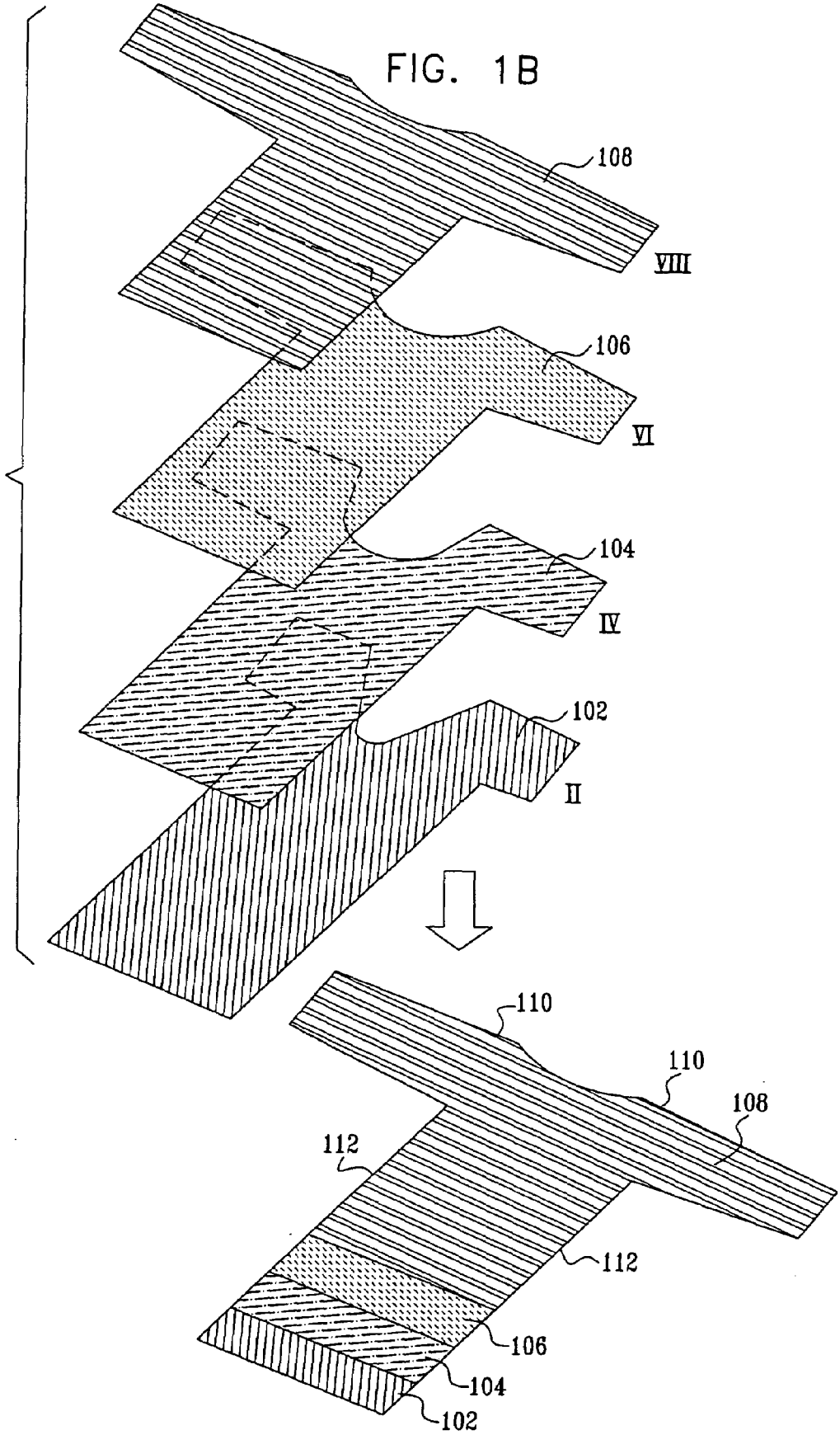
FIG. 1B is a diagrammatic illustration of the back of the garment of FIG. 1A and its constituent panels.

Reference is now made to FIG. 1A, which is a diagrammatic illustration of the front of a garment and its constituent panels constructed and operative in accordance with a preferred embodiment of the present invention and to FIG. 1B which is a diagrammatic illustration of the back of the garment of FIG. 1A and its constituent panels.

As seen in FIGS. 1A and 1B, the garment of FIGS. 1A and 1B preferably comprises an upper torso portion including multiple garment body panels 102, 104, 106 and 108, which are preferably joined along shoulder seams 110 and body side seams 112. It is appreciated that body panels 102, 104, 106 and 108 are not joined at neck edges or bottom edges thereof. As seen in FIGS. 1A and 1B, body panels 102, 104, 106 and 108 each comprise a single piece and are non-openable. As seen in FIGS. 1A and 1B, each body panel may have a cut, which is different from that of one or more of the other panels. It is appreciated that any suitable number of body panels in excess of two may be provided.

It is also seen from a consideration of FIGS. 1A and 1B that opposite sides of each of the body panels may be printed with or otherwise bear different colors and or patterns. In the illustrated embodiment, each side of each body panel is different from each other side. For convenience, the eight different sides of the body panels are labeled in the illustrated example by letters: I, II, III, IV, V, VI, VII and VIII, wherein sides I and II correspond to body panel 102, sides III and IV correspond to body panel 104, sides V and VI correspond to body panel 106 and sides VII and VIII correspond to body panel 108.

Figure 2A:
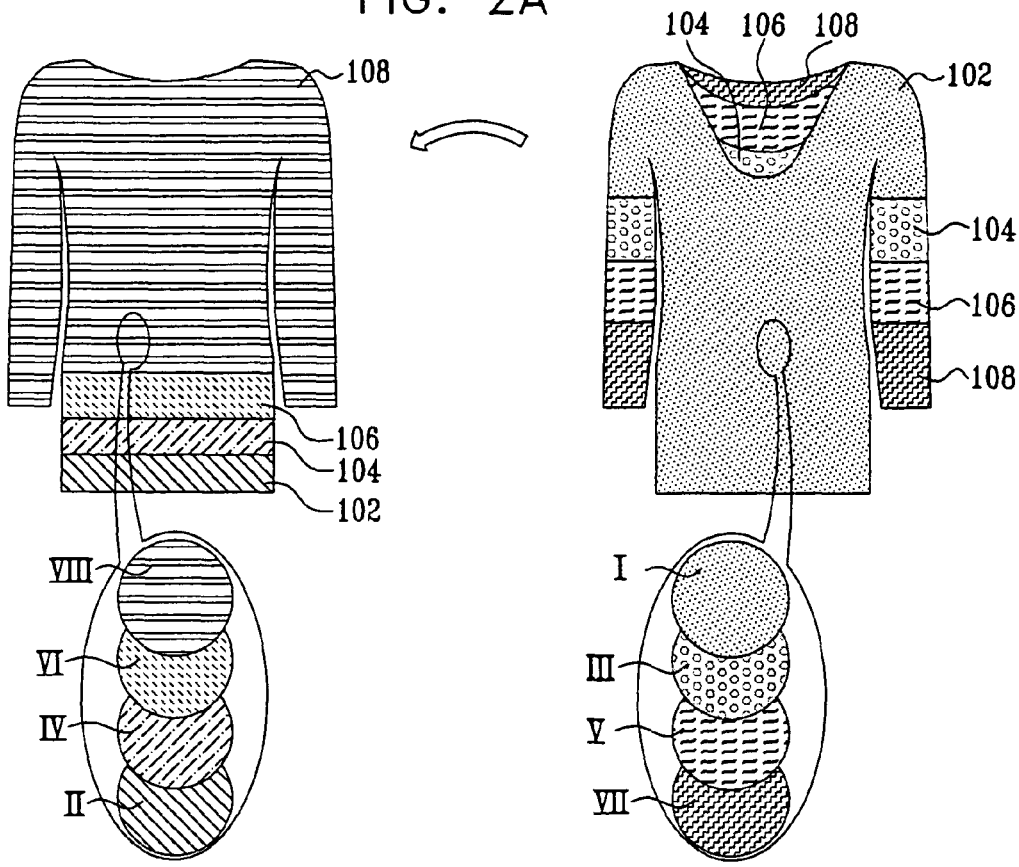
FIGS. 2A-2D are illustrations of the front and the back of the garment of FIGS. 1A and 1B in four alternative panel arrangements.

Reference is made to FIGS. 2A-2D, which are illustrations of the front and the back of the garment of FIGS. 1A and 1B in four alternative panel arrangements. It is seen from FIGS. 2A-2D that in the illustrated example, there are four permutations of how the body panels of the garment can be arranged. In the arrangement of FIG. 2A, body panels 102 and 108 are outer panels and body panels 104 and 106 are inner panels.

Figure 2B:
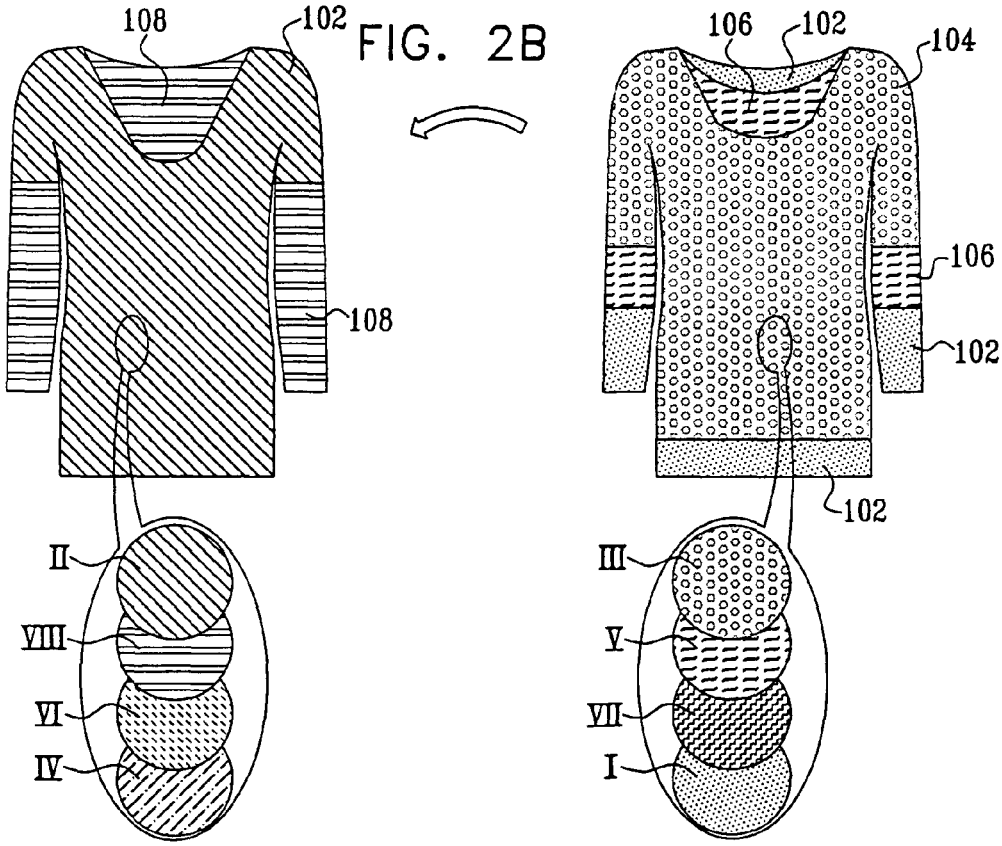
Figure 2C:
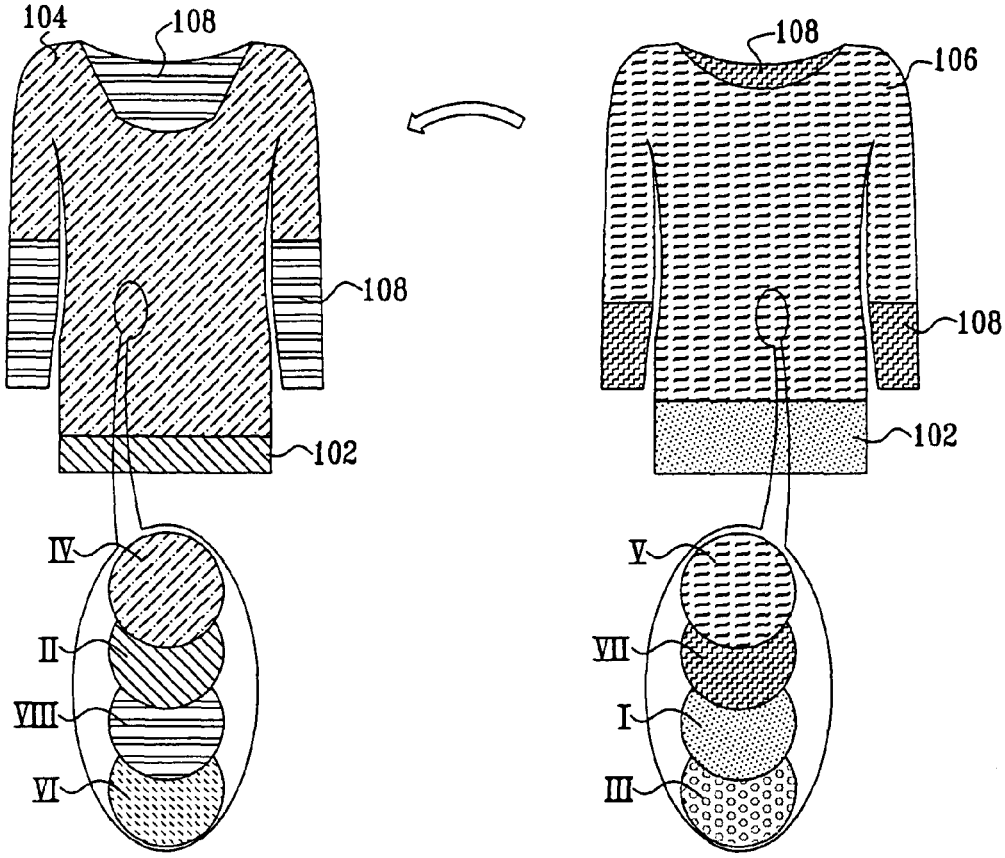
Figure 2D:
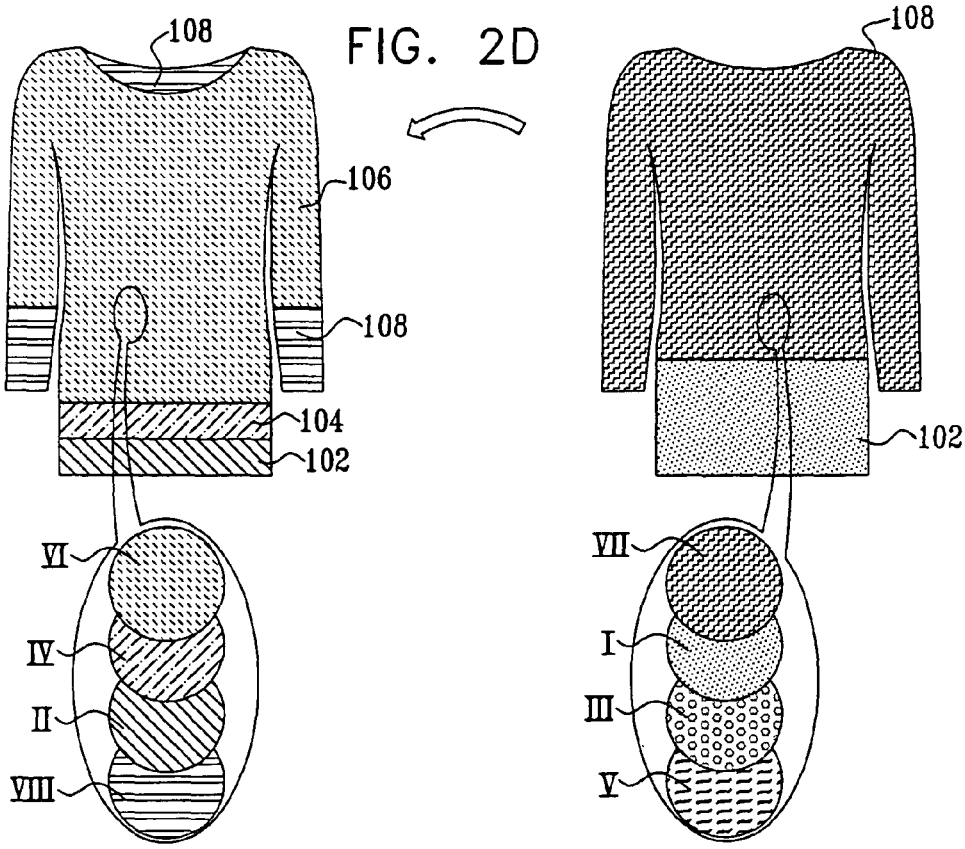

In the arrangement of FIG. 2B, body panels 104 and 102 are outer panels and body panels 106 and 108 are inner panels. In the arrangement of FIG. 2C, body panels 106 and 104 are outer panels and body panels 108 and 102 are inner panels. In the arrangement of FIG. 2D, body panels 108 and 106 are outer panels and body panels 102 and 104 are inner panels.

Reference is now made to FIGS. 3A-3F, which are illustrations of the front and the back of the garment of FIGS. 1A-2D in the panel arrangement of FIG. 2A in six different wearing arrangements. It can be seen that in the illustrated embodiment, there are six permutations of how the garment, arranged as seen in FIG. 2A, may be worn.

Figure 3A:
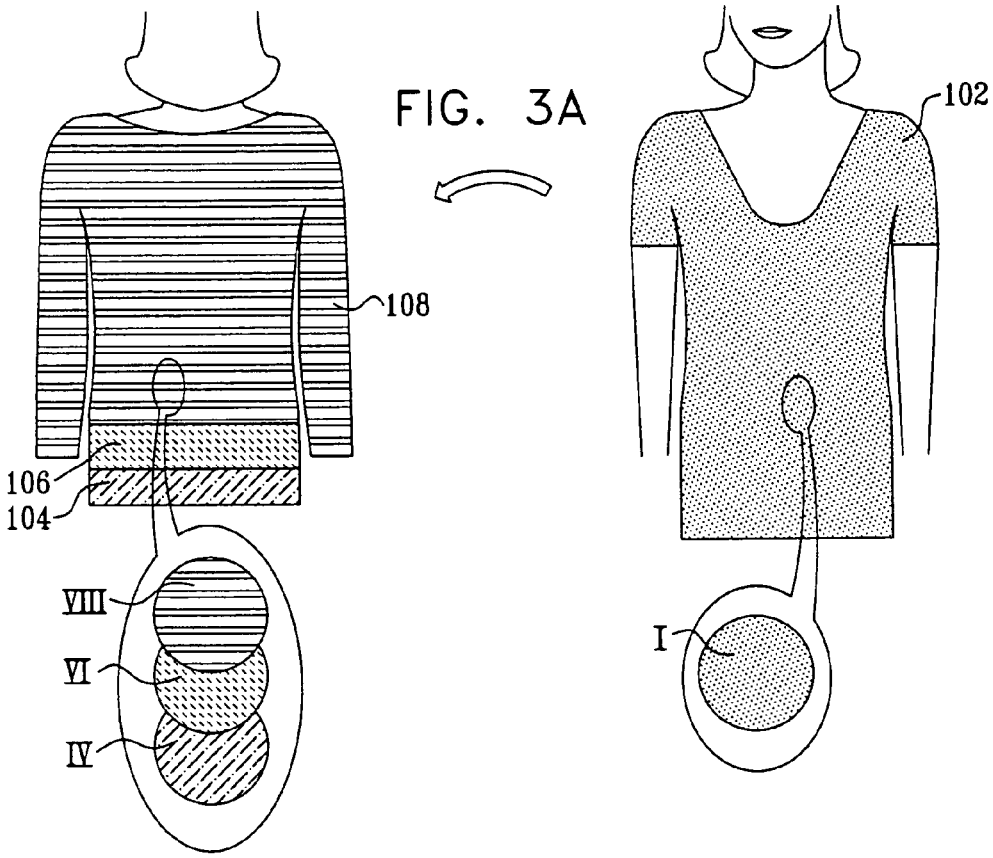
FIGS. 3A-3F are illustrations of the front and the back of the garment of FIGS. 1A-2D in the panel arrangement of FIG. 2A in six different wearing arrangements.

In. FIG. 3A, it is seen that the garment may be worn with body panel 102 at the front and body panels 108, 106 and 104 at the back, with side I of body panel 102 appearing at the front and side VIII of body panel 108, side VI of body panel 106 and side IV of body panel 104 appearing at the back.

Figure 3B:
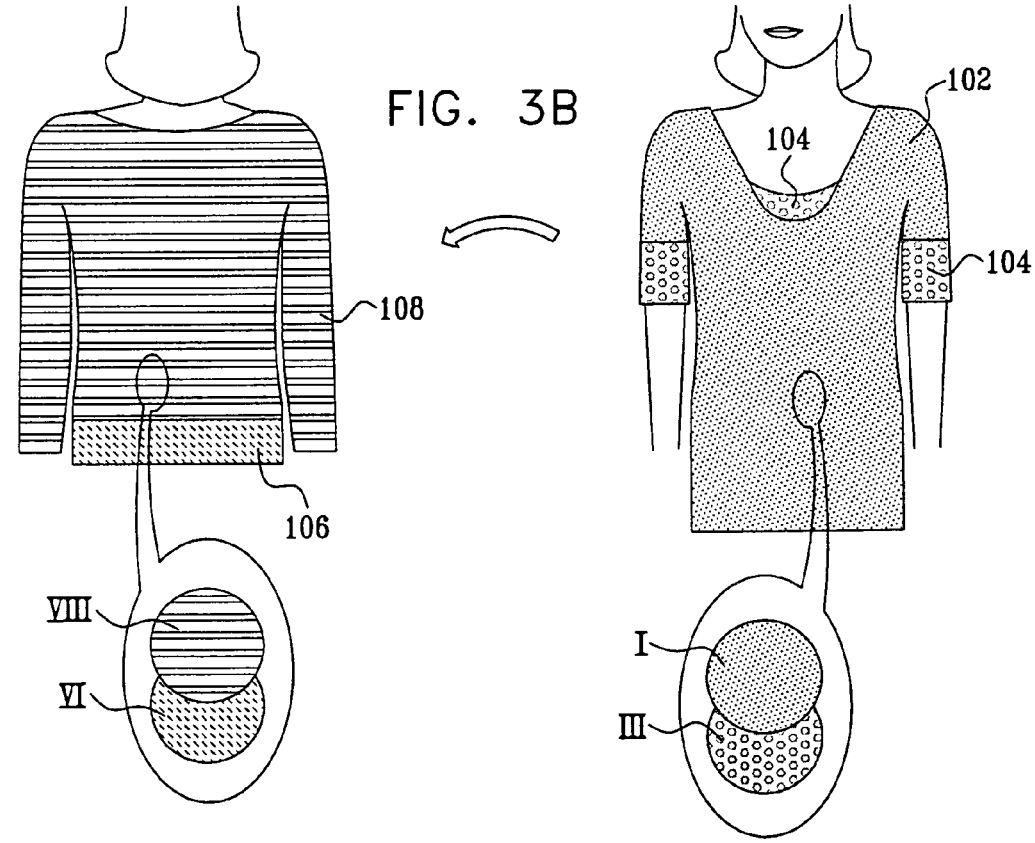

In FIG. 3B, it is seen that the garment may be worn with body panels 102 and 104 at the front and body panels 108 and 106 at the back, with side I of body panel 102 and side III of body panel 104 appearing at the front and side VIII of body panel 108 and side VI of body panel 106 appearing at the back.

Figure 3C:
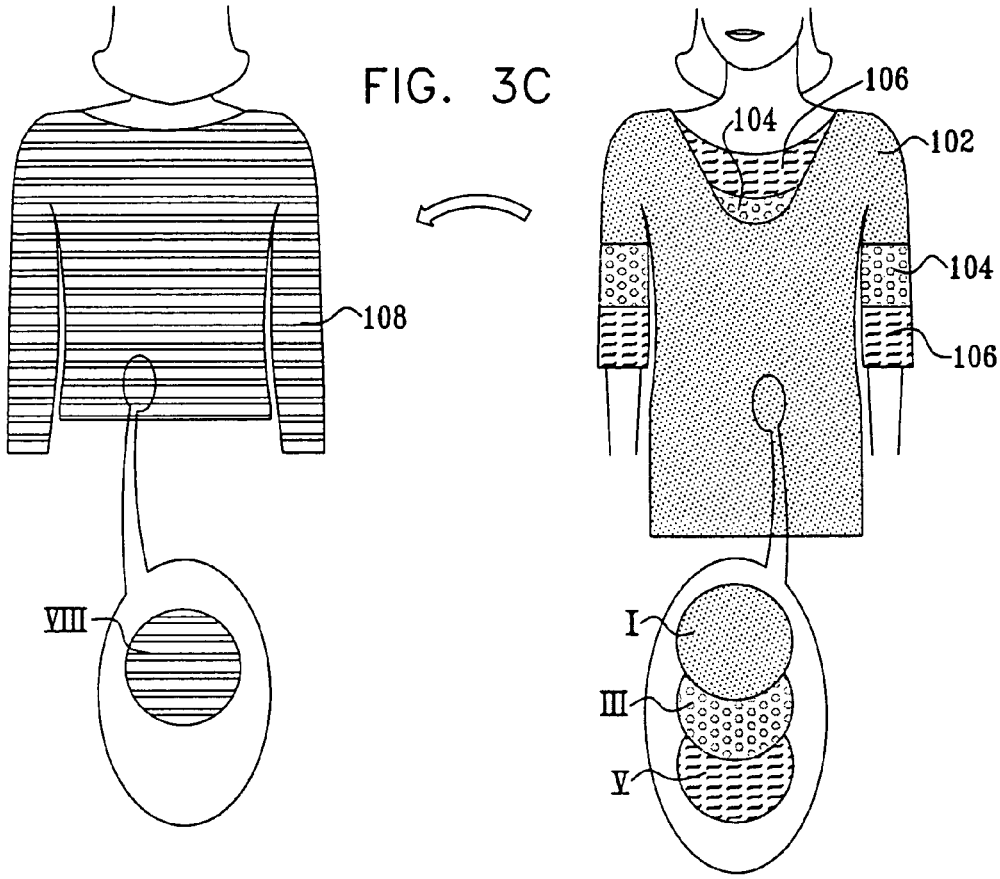

In FIG. 3C, it is seen that the garment may be worn with body panels 102, 104 and 106 at the front and body panel 108 at the back, with side I of body panel 102, side III of body panel 104 and side V of body panel 106 appearing at the front and side VIII of body panel 108 appearing at the back.

As seen in FIGS. 3A-3F, the body panels are not joined from the two side scams up to the shoulder seams, thereby allowing the wearers arms to be placed between different ones of the body panels in each of the ways of wearing the garment.

Figure 3D:
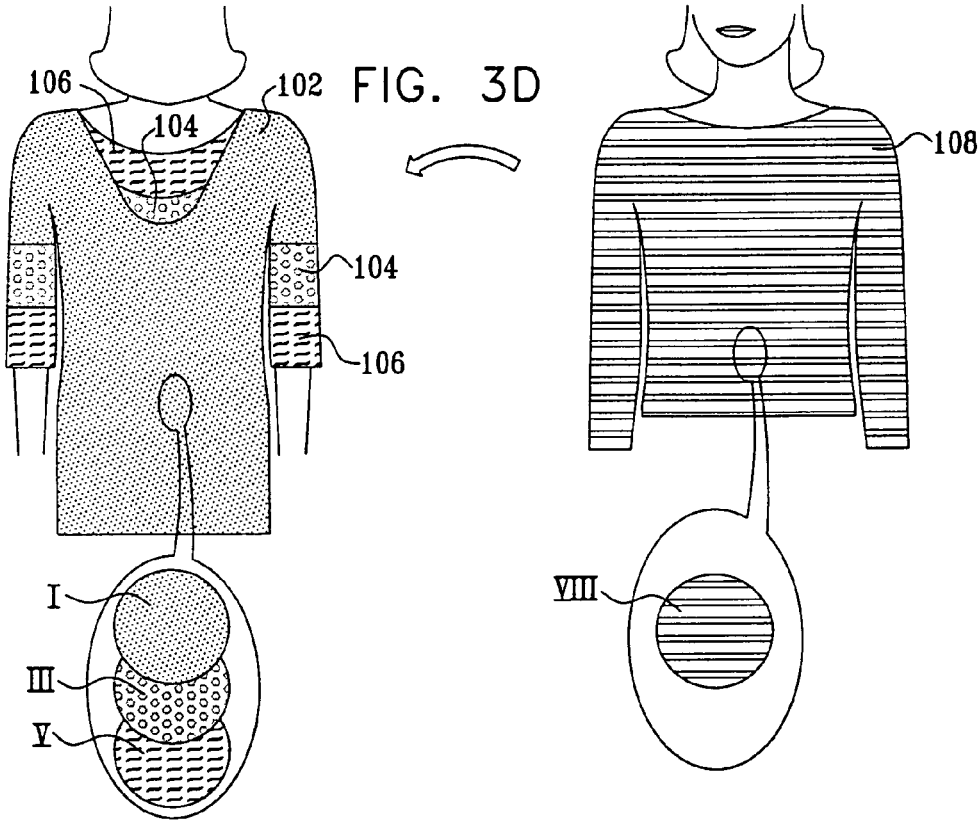

In FIG. 3D, it is seen that the garment may be worn with body panel 108 at the front and body panels 102, 104 and 106 at the back, with side VIII of body panel 108 appearing at the front and side I of body panel 102, side III of body panel 104 and side V of body panel 106 appearing at the back.

Figure 3E:
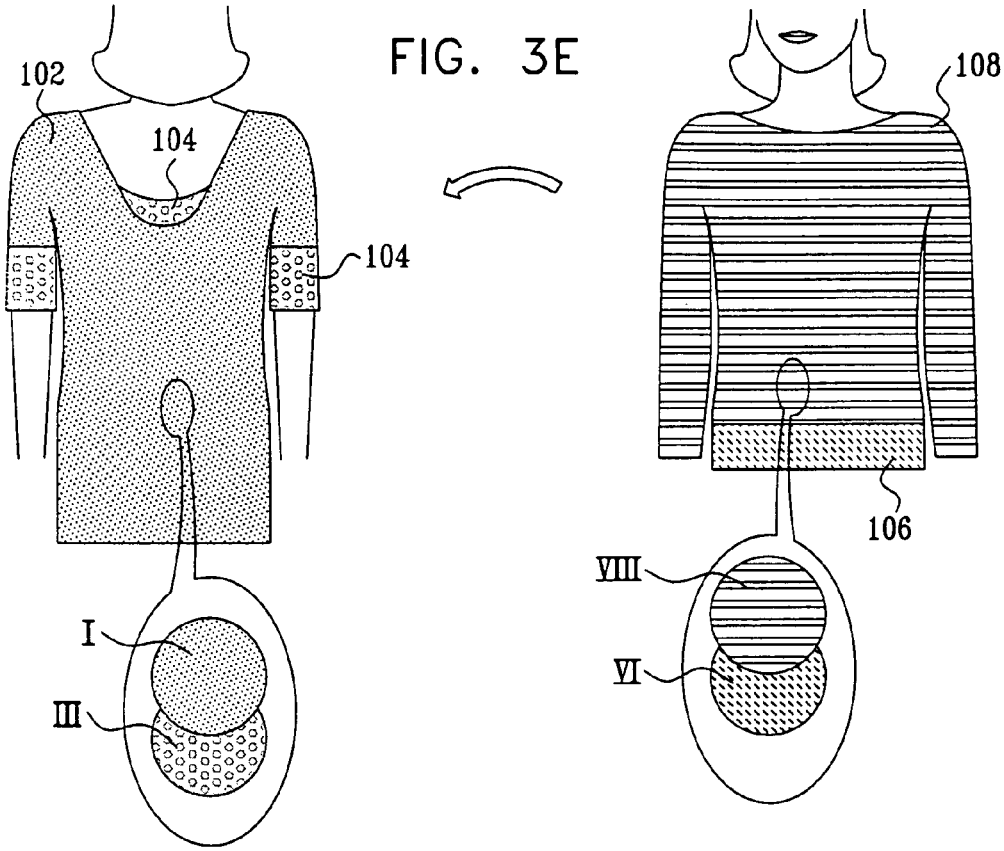

In FIG. 3E, it is seen that the garment may be worn with body panels 108 and 106 at the front and body panels 102 and 104 at the back, with side VIII of body panel 108 and side VI of body panel 106 appearing at the front and side I of body panel 102 and side III of body panel 104 appearing at the back.

Figure 3F:
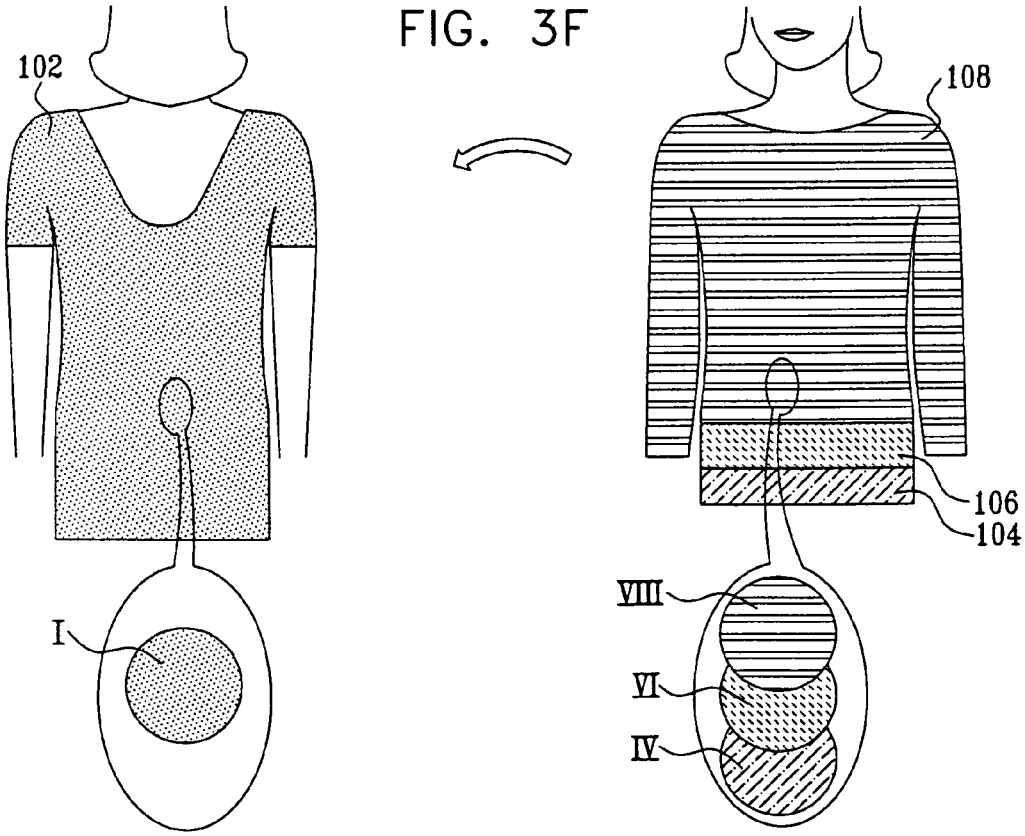

In FIG. 3F, it is seen that the garment may be worn with body panels 108, 106 and 104 at the front and body panel 102 at the back, with side VIII of body panel 108, side VI of body panel 106 and side IV of body panel 104 appearing at the front and side I of body panel 102 appearing at the back.

Reference is now made to FIGS. 4A-4F, which are illustrations of the front and the back of the garment of FIGS. 1A-2D in the panel arrangement of FIG. 2B in six different wearing arrangements. It can be seen that in the illustrated embodiment, there are six permutations of how the garment, arranged as seen in FIG. 2B, may be worn.

Figure 4A:
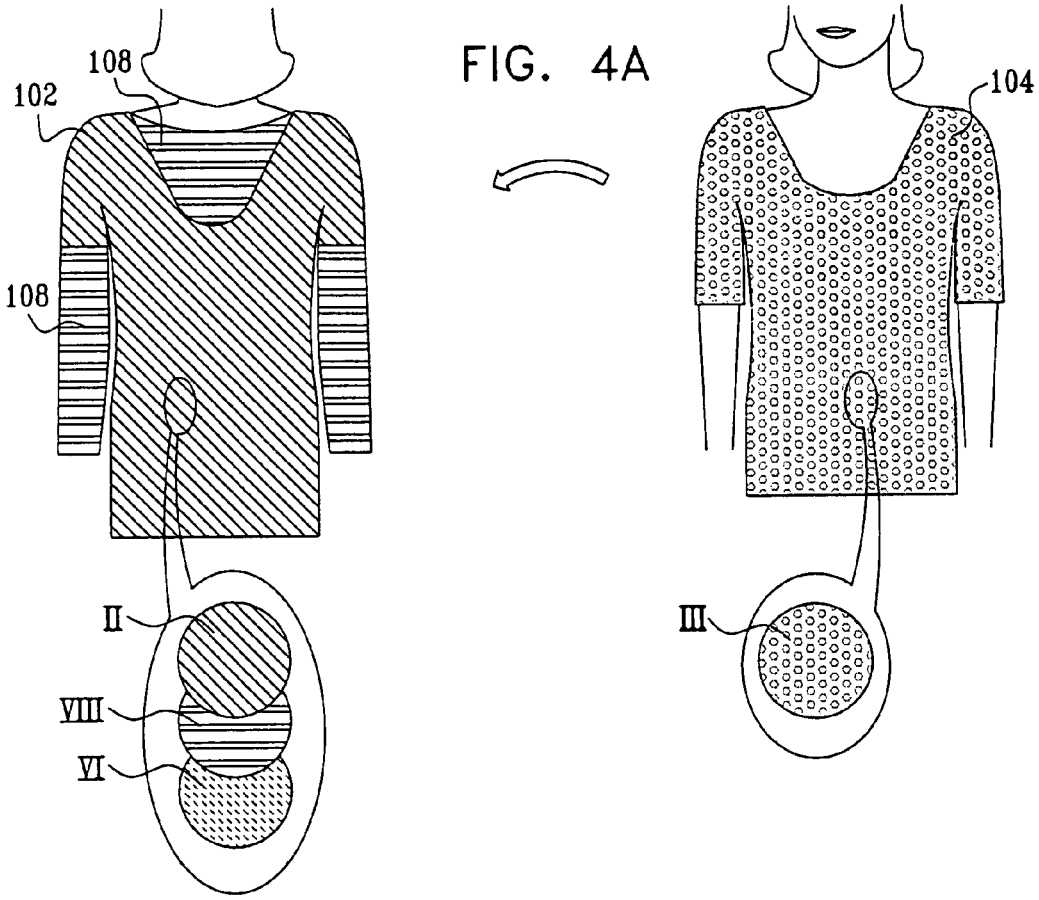
FIGS. 4A-4F are illustrations of the front and the back of the garment of FIGS. 1A-2D in the panel arrangement of FIG. 2B in six different wearing arrangements.

In FIG. 4A, it is seen that the garment may be worn with body panel 104 at the front and body panels 102, 108 and 106 at the back, with side III of body panel 104 appearing at the front and side II of body panel 102 and side VIII of body panel 108 appearing at the back. It is noted that in the illustrated embodiment side VI of body panel 106 is covered by side II of body panel 102 and side VIII of body panel 108.

Figure 4B:
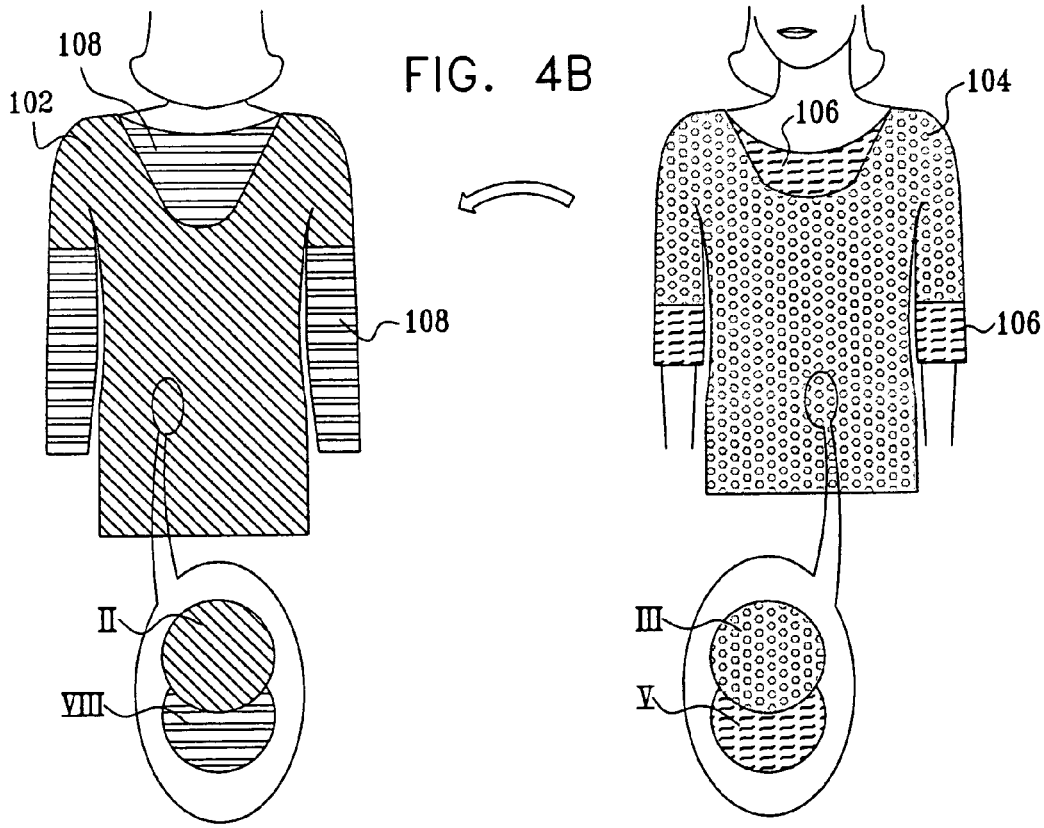

In FIG. 4B, it is seen that the garment may be worn with body panels 104 and 106 at the front and body panels 102 and 108 at the back, with side III of body panel 104 and side V of body panel 106 appearing at the front and side II of body panel 102 and side VIII of body panel 108 appearing at the back.

Figure 4C:
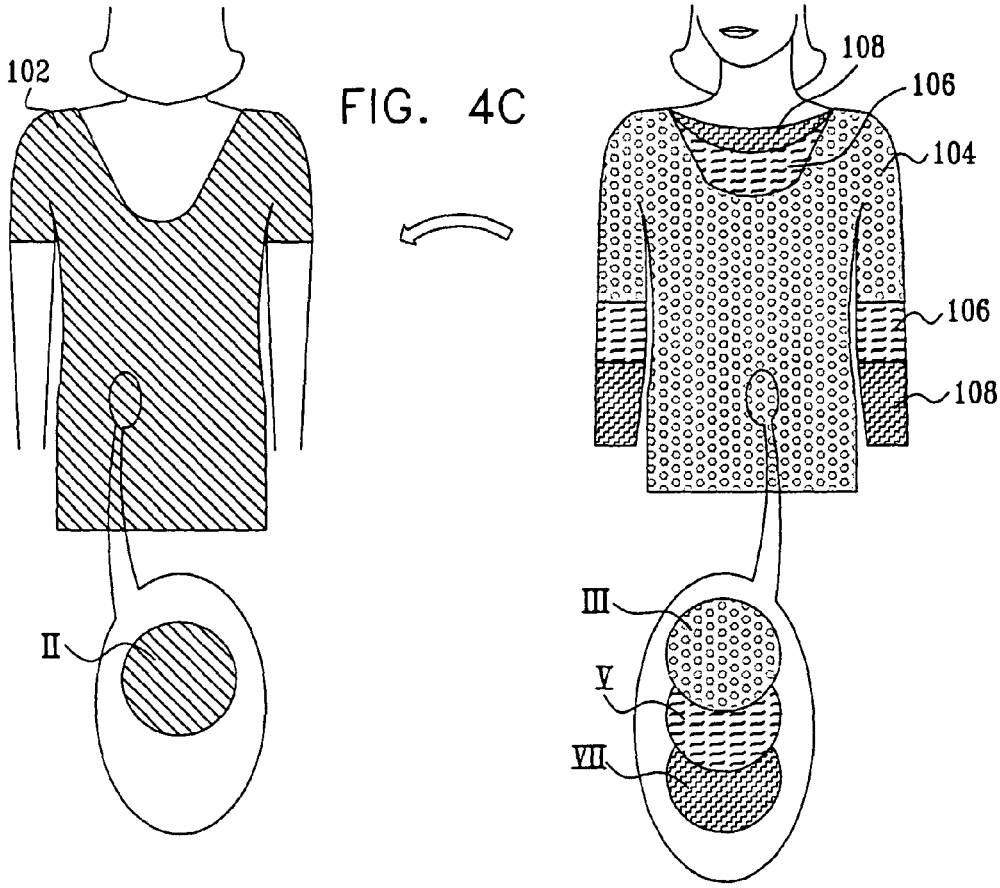

In FIG. 4C, it is seen that the garment may be worn with body panels 104, 106 and 108 at the front and body panel 102 at the back, with side III of body panel 104, side V of body panel 106 and side VII of body panel 108 appearing at the front and side II of body panel 102 appearing at the back.

Figure 4D:
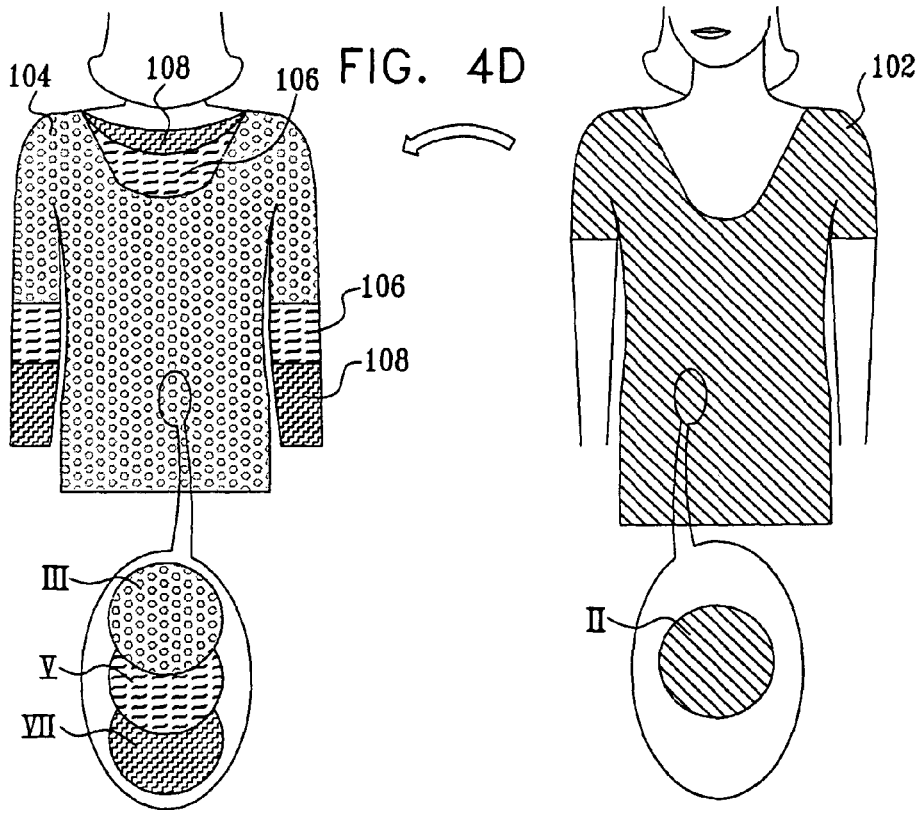

In FIG. 4D, it is seen that the garment may be worn with body panel 102 at the front and body panels 104, 106 and 108 at the back, with side II of body panel 102 appearing at the front and side III of body panel 104, side V of body panel 106 and side VII of body panel 108 appearing at the back.

Figure 4E:
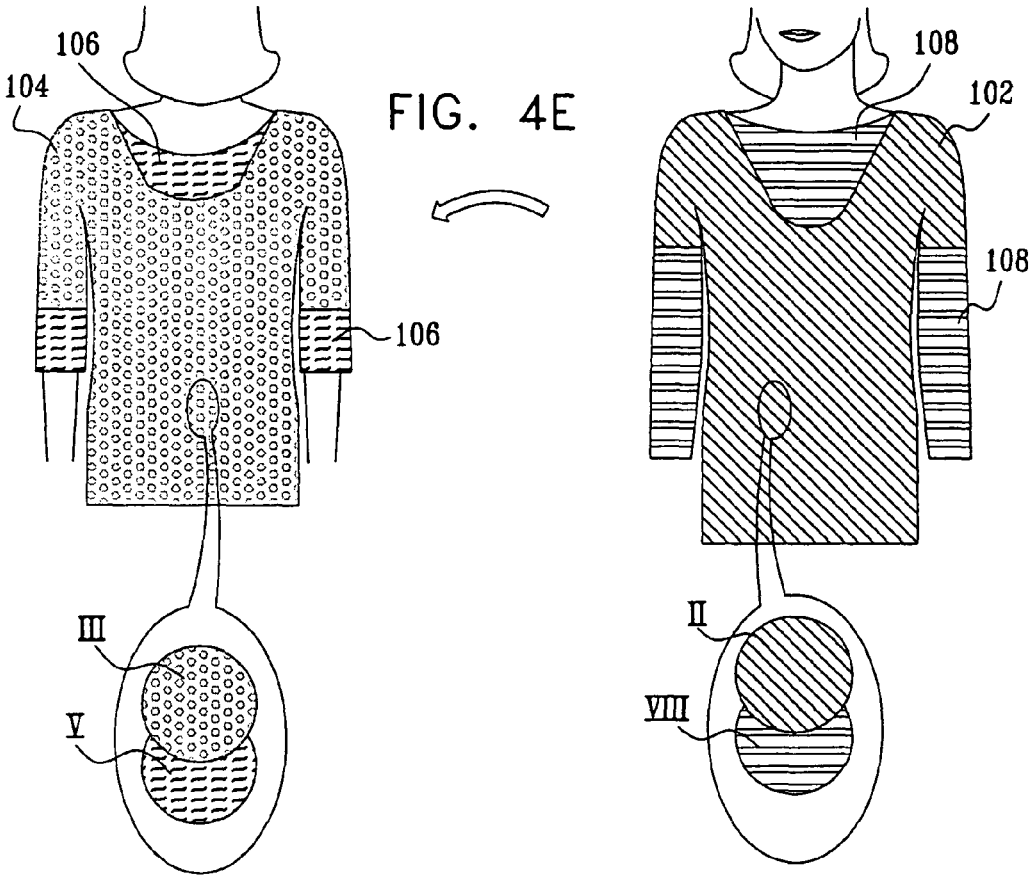

In FIG. 4E, it is seen that the garment may be worn with body panels 102 and 108 at the front and body panels 104 and 106 at the back, with side II of body panel 102 and side VIII of body panel 108 appearing at the front and side III of body panel 104 and side V of body panel 106 appearing at the back.

Figure 4F:
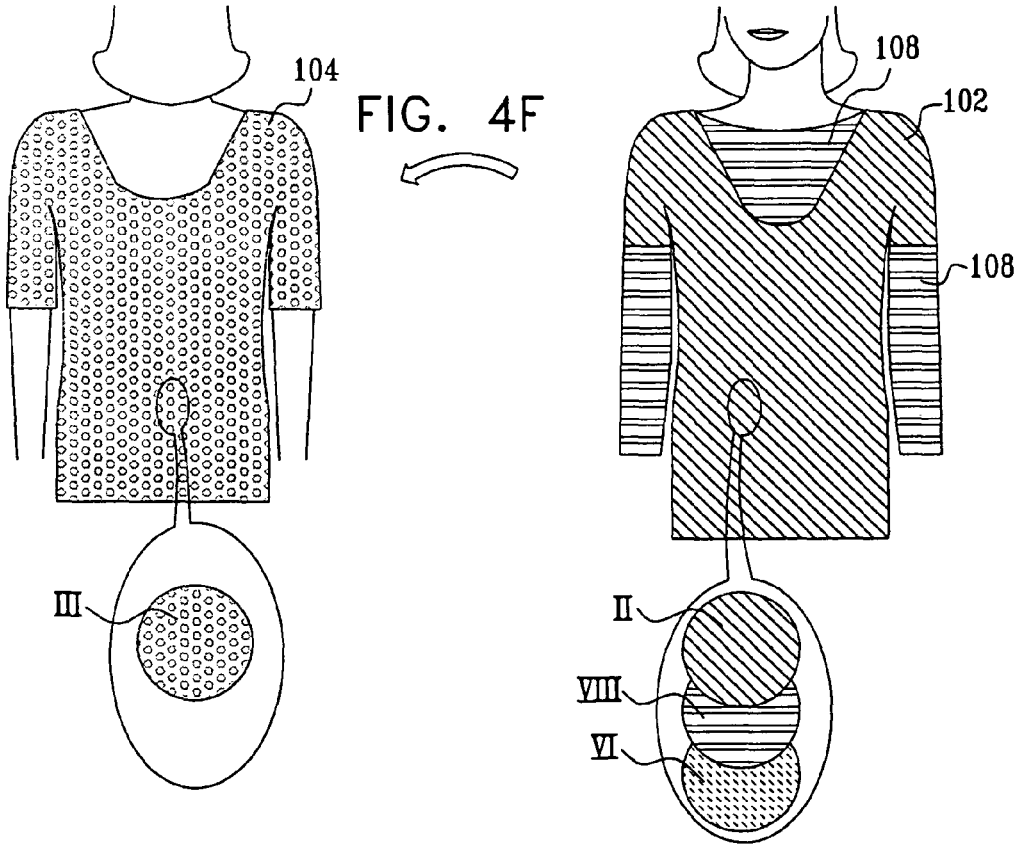

In FIG. 4F, it is seen that the garment may be worn with body panels 102, 108 and 106 at the front and body panel 104 at the back, with side II of body panel 102, and side VIII of body panel 108 appearing at the front and side III of body panel 104 appearing at the back. It is noted that in the illustrated embodiment side VI of body panel 106 is covered by side II of body panel 102 and side VIII of body panel 108.

Reference is now made to FIGS. 5A-5F, which are illustrations of the front and the back of the garment of FIGS. 1A-2D in the panel arrangement of FIG. 2C in six different wearing arrangements. It can be seen that in the illustrated embodiment, there are six permutations of how the garment, arranged as seen in FIG. 2C, may be worn.

Figure 5A:
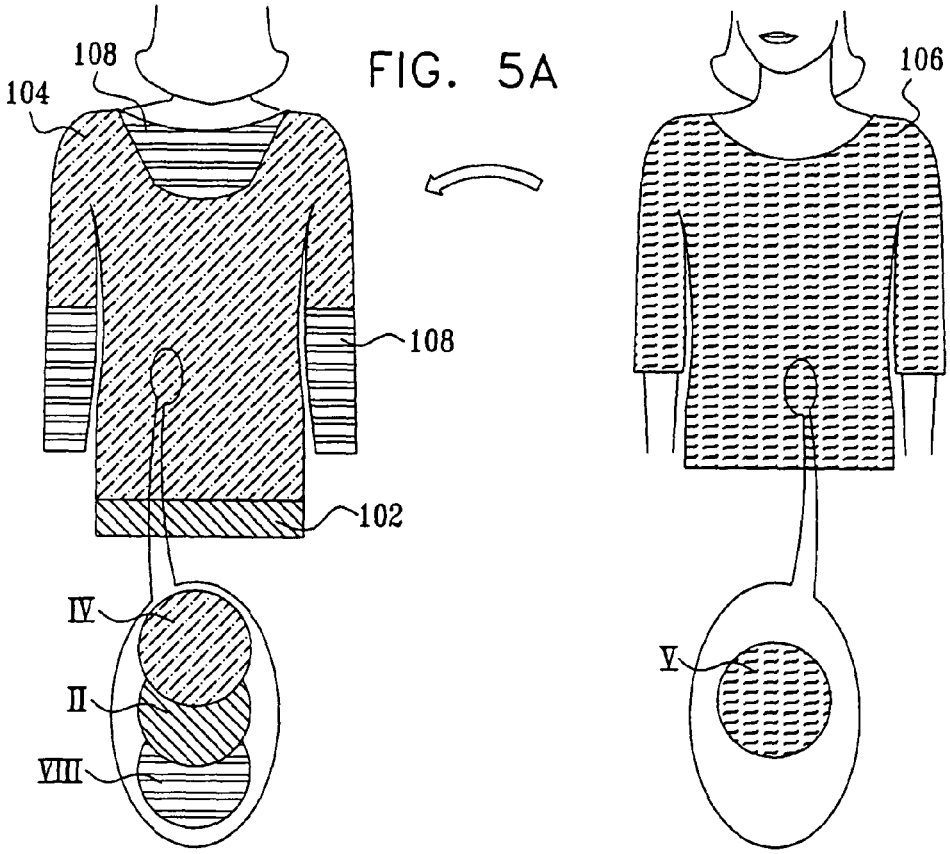
FIGS. 5A-5F are illustrations of the front and the back of the garment of FIGS. 1A-2D in the panel arrangement of FIG. 2C in six different wearing arrangements.

In FIG. 5A, it is seen that the garment may be worn with body panel 106 at the front and body panels 104, 102 and 108 at the back, with side V of body panel 106 appearing at the front and side IV of body panel 104, side II of body panel 102 and side VIII of body panel 108 appearing at the back.

Figure 5B:
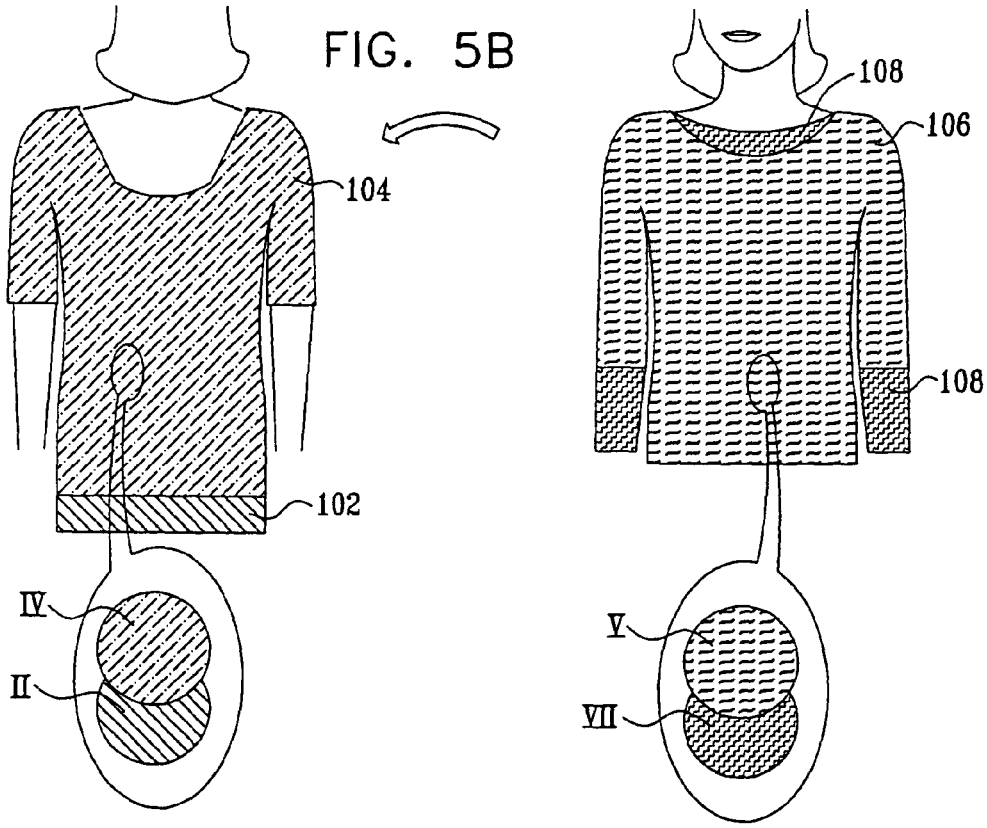

In FIG. 5B, it is seen that the garment may be worn with body panels 106 and 108 at the front and body panels 104 and 102 at the back, with side V of body panel 106 and side VII of body panel 108 appearing at the front and side IV of body panel 104 and side II of body panel 102 appearing at the back.

Figure 5C:
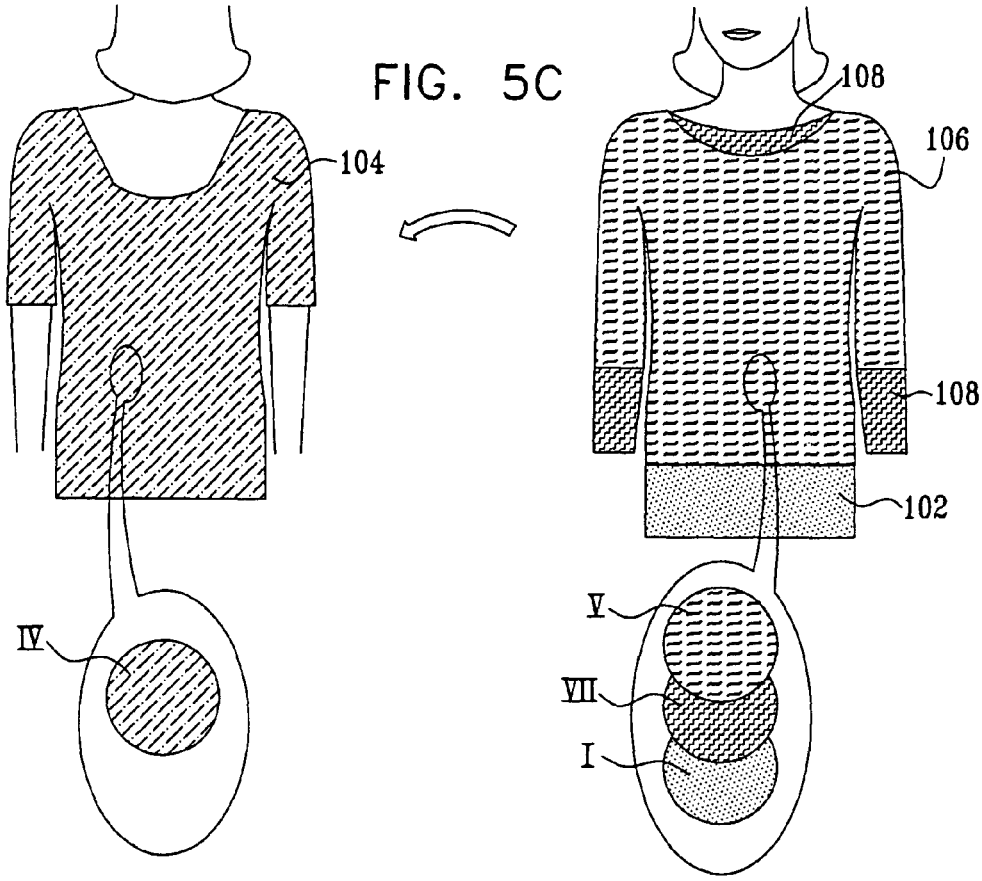

In FIG. 5C, it is seen that the garment may be worn with body panels 106, 108 and 102 at the front and body panel 104 at the back, with side V of body panel 106, side VII of body panel 108 and side I of body panel 102 appearing at the front and side IV of body panel 104 appearing at the back.

Figure 5D:
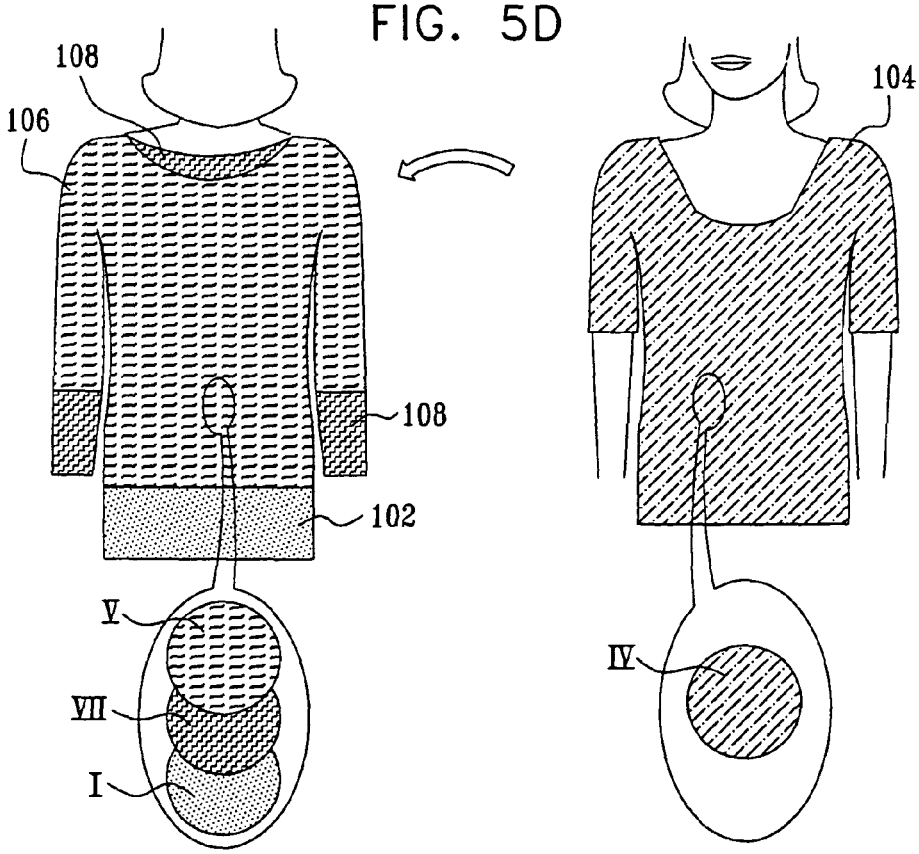

In FIG. 5D, it is seen that the garment may be worn with body panel 104 at the front and body panels 106, 108 and 102 at the back, with side IV of body panel 104 appearing at the front and side V of body panel 106, side VII of body panel 108 and side I of body panel 102 appearing at the back.

Figure 5E:
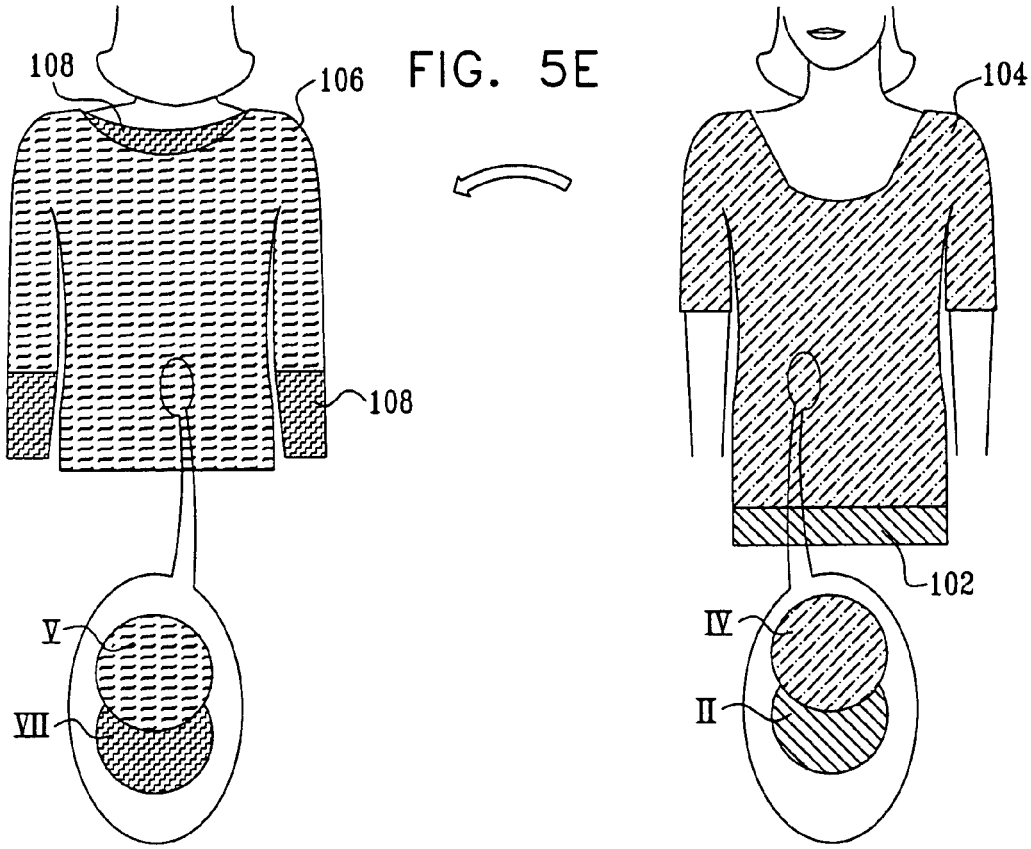

In FIG. 5E, it is seen that the garment may be worn with body panels 104 and 102 at the front and body panels 106 and 108 at the back, with side IV of body panel 104 and side II of body panel 102 appearing at the front and side V of body panel 106 and side VII of body panel 108 appearing at the back.

Figure 5F:
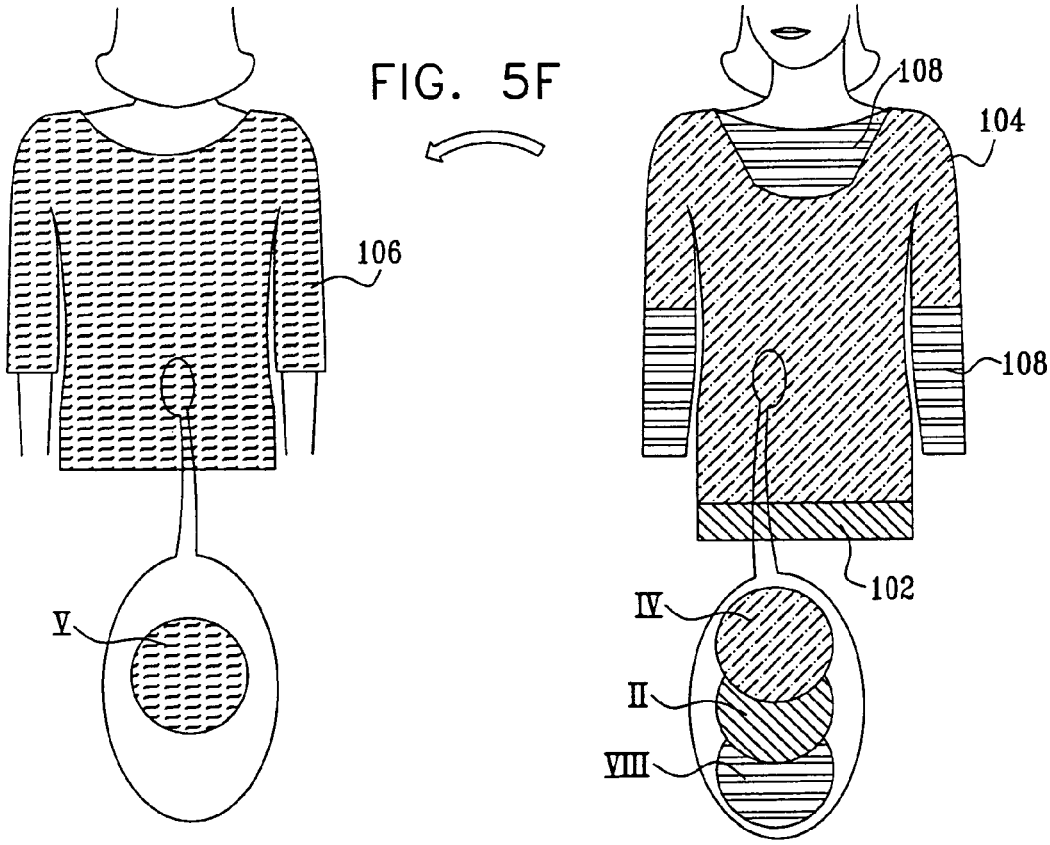

In FIG. 5F, it is seen that the garment may be worn with body panels 104, 102 and 108 at the front and body panel 106 at the back, with side IV of body panel 104, side II of body panel 102 and side VIII of body panel 108 appearing at the front and side V of body panel 106 appearing at the back.

Reference is now made to FIGS. 6A-6F, which are illustrations of the front and the back of the garment of FIGS. 1A-2D in the panel arrangement of FIG. 2D in six different wearing arrangements. It can be seen that in the illustrated embodiment, there are six permutations of how the garment, arranged as seen in FIG. 2D, may be worn.

Figure 6A:
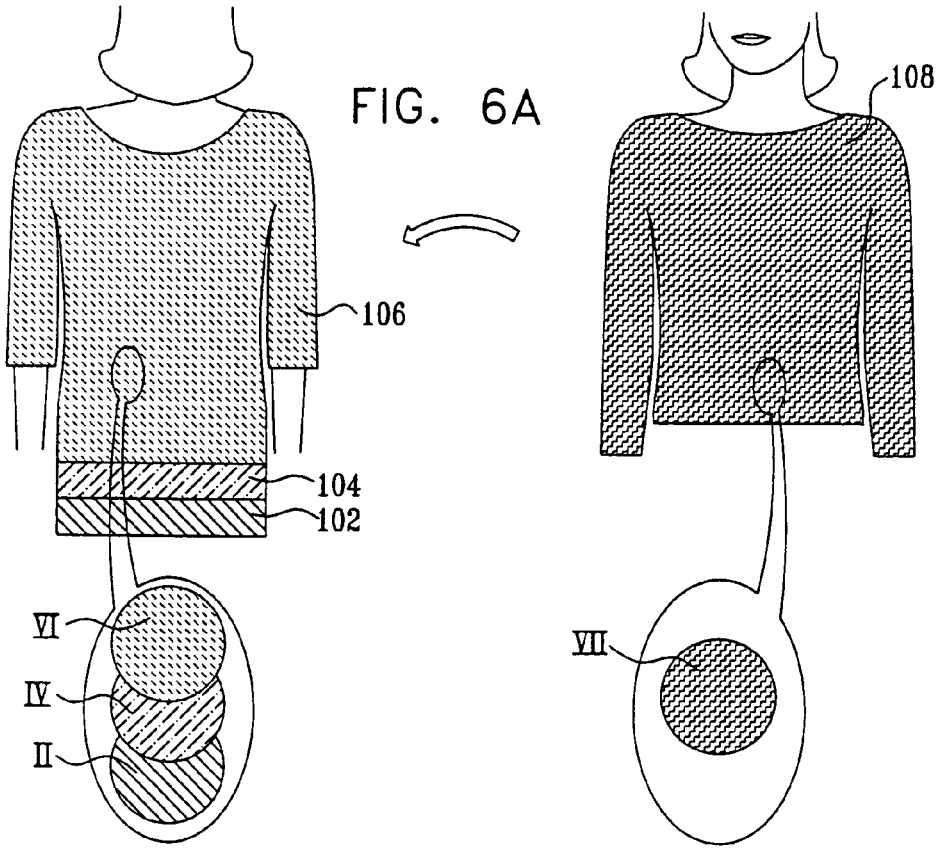
FIGS. 6A-6F are illustrations of the front and the back of the garment of FIGS. 1A-2D in the panel arrangement of FIG. 2D in six different wearing arrangements.

In FIG. 6A, it is seen that the garment may be worn with body panel 108 at the front and body panels 106, 104 and 102 at the back, with side VII of body panel 108 appearing at the front and side VI of body panel 106, side IV of body panel 104 and side II of body panel 102 appearing at the back.

Figure 6B:
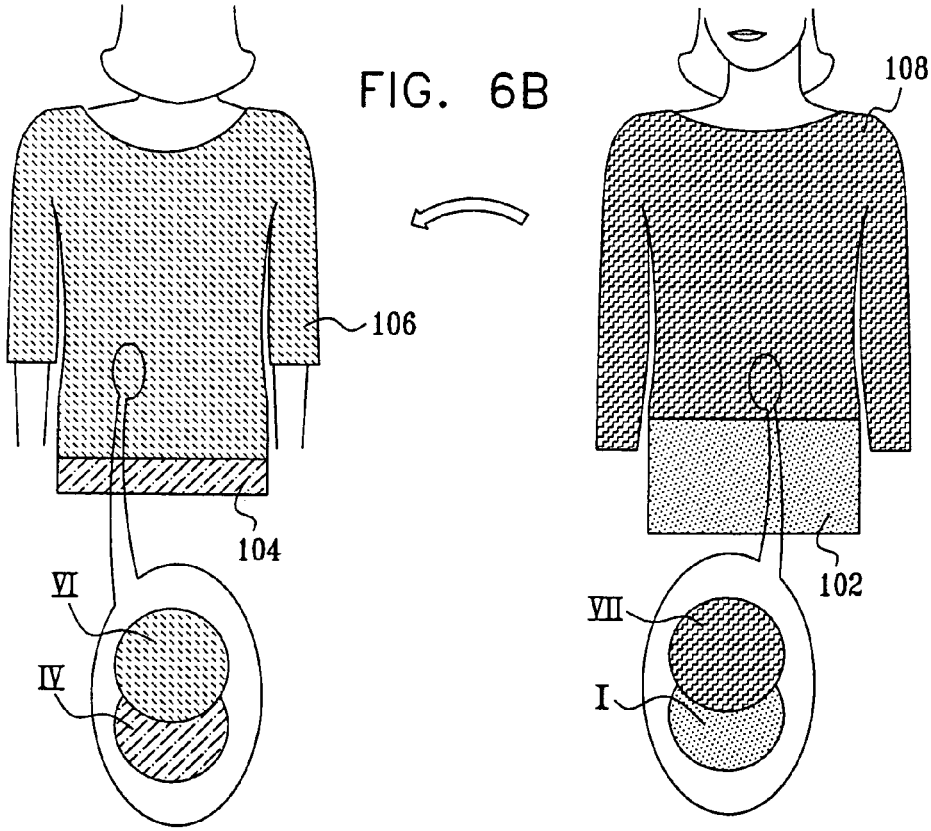

In FIG. 6B, it is seen that the garment may be worn with body panels 108 and 102 at the front and body panels 106 and 104 at the back, with side VII of body panel 108 and side I of body panel 102 appearing at the front and side VI of body panel 106 and side IV of body panel 104 appearing at the back.

Figure 6C:
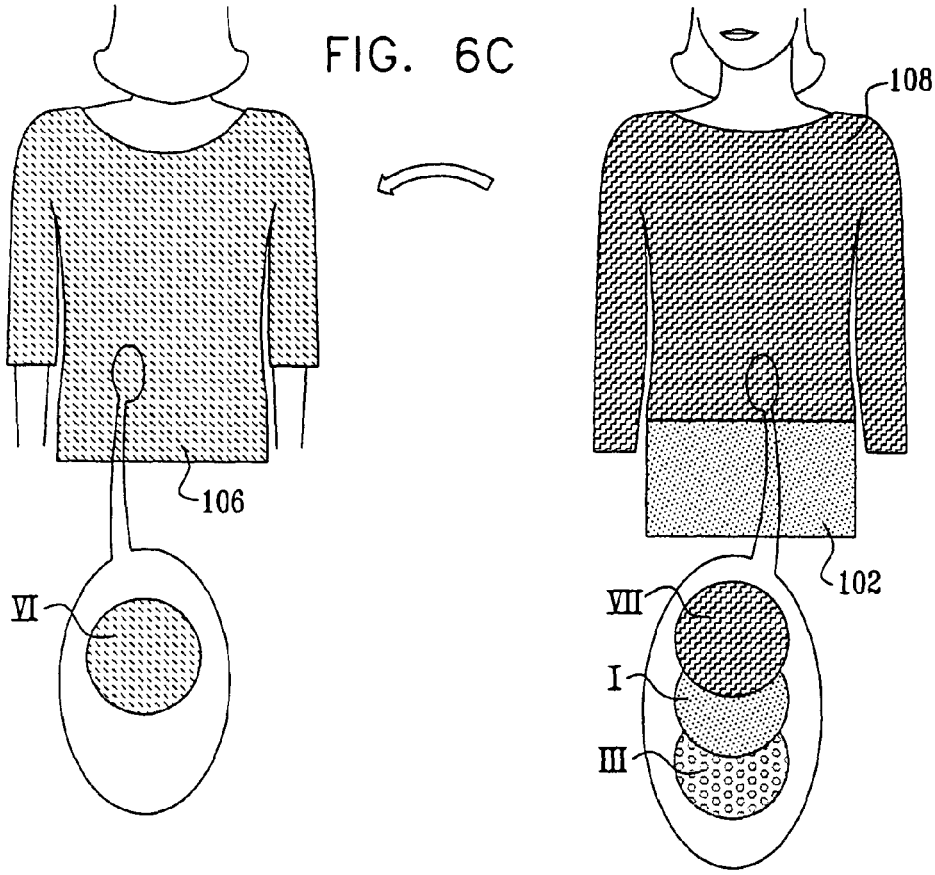

In FIG. 6C, it is seen that the garment may be worn with body panels 108, 102 and 104 at the front and body panel 106 at the back, with side VII of body panel 108 and side I of body panel 102 appearing at the front and side VI of body panel 106 appearing at the back. It is noted that in the illustrated embodiment side III of body panel 104 is covered by side VII of body panel 108 and side I of body panel 102.

Figure 6D:
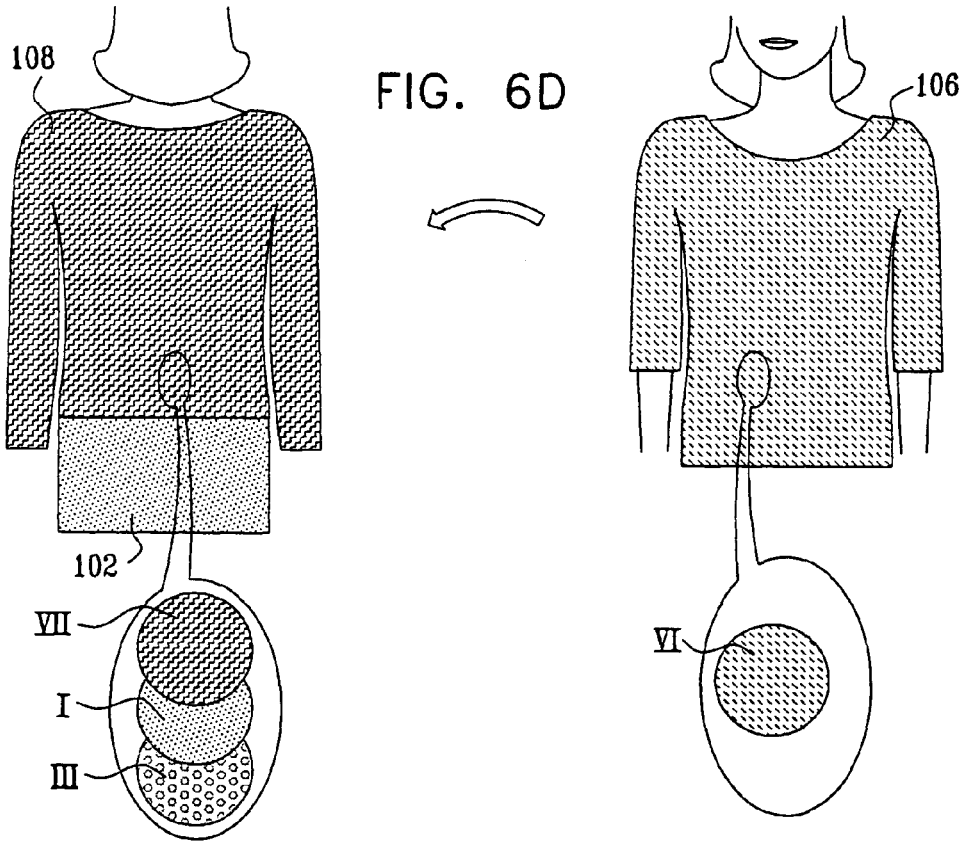

In FIG. 6D, it is seen that the garment may be worn with body panel 106 at the front and body panels 108, 102 and 104 at the back, with side VI of body panel 106 appearing at the front and side VII of body panel 108 and side I of body panel 102 appearing at the back. It is noted that in the illustrated embodiment side III of body panel 104 is covered by side VII of body panel 108 and side I of body panel 102.

Figure 6E:
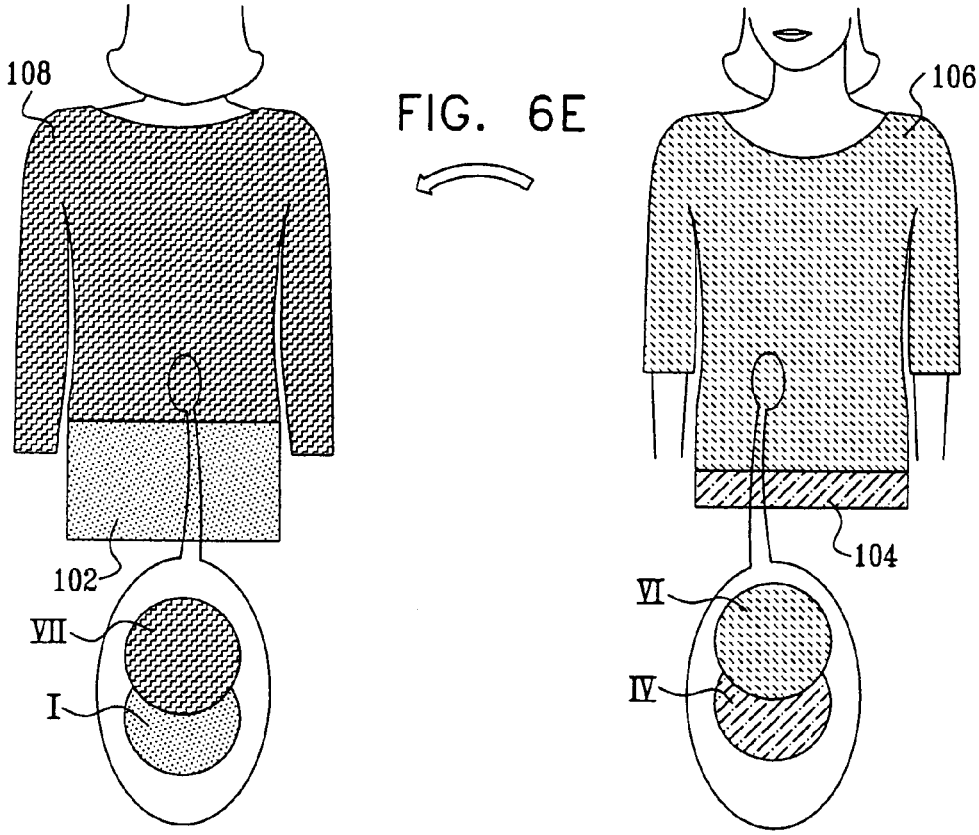

In FIG. 6E, it is seen that the garment may be worn with body panels 106 and 104 at the front and body panels 108 and 102 at the back, with side VI of body panel 106 and side IV of body panel 104 appearing at the front and side VII of body panel 108 and side I of body panel 102 appearing at the back.

Figure 6F:
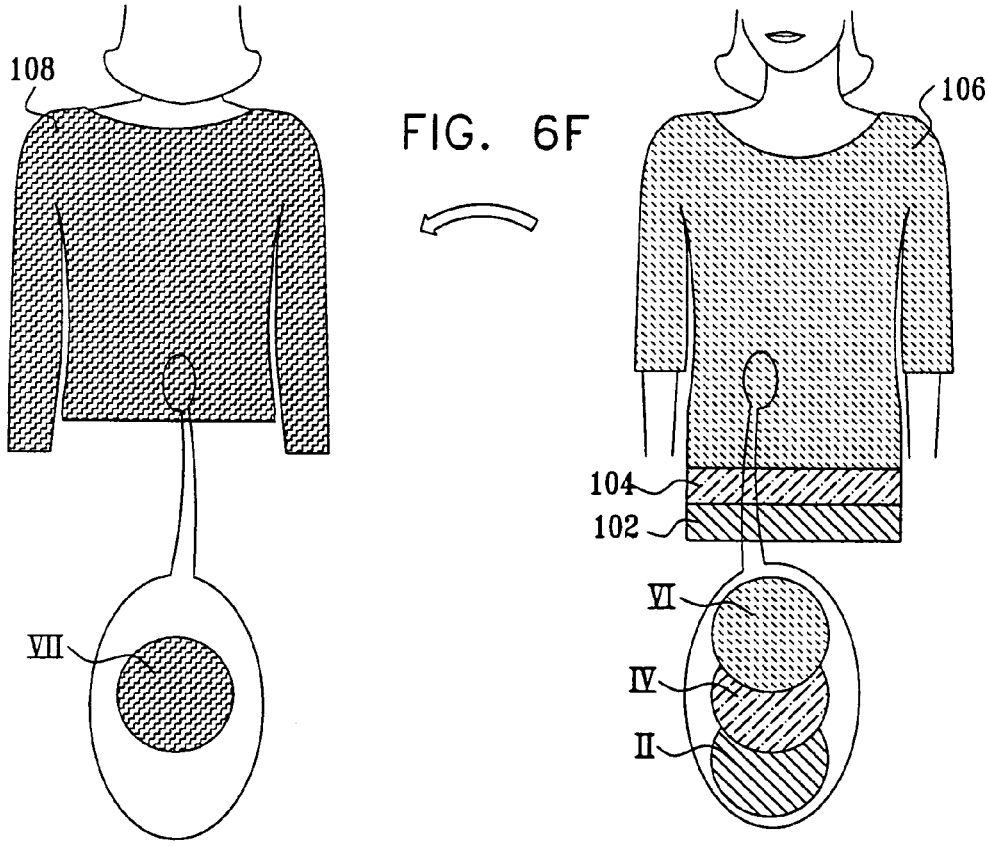

In FIG. 6F, it is seen that the garment may be worn with body panels 106, 104 and 102 at the front and body panel 108 at the back, with side VI of body panel 106, side IV of body panel 104 and side II of body panel 102 appearing at the front and side VII of body panel 108 appearing at the back.

It will be appreciated by persons skilled in the art that the present invention is not limited by what has been particularly shown and described herein above. Rather the scope of the present invention includes both combinations and subcombinations of the various features described hereinabove as well as variations and modifications which would occur to persons skilled in the art upon reading the specifications and which are not in the prior art.

The invention claimed is:

1. A reversible garment including at least an upper torso portion comprising at least three separate non-openable body panels, having two body side seams and at least one shoulder seam, all of said at least three body panels being joined together along at least a substantial portion by said two side seams and along said at least one shoulder seam but not being joined from said two side seams up to said shoulder seams, at least three of said at least three body panels not being joined at neck edges other than adjacent said at least one shoulder seam, at least three of said at least three body panels not being joined at bottom edges of the body panels other than adjacent said side seams.

2. A reversible garment according to claim 1 and wherein at least two of said at least three body panels have different cuts.

3. A reversible garment according to claim 2 and wherein said garment is a top.

4. A reversible garment according to claim 2 and wherein at least one of said at least three body panels has sides having differing appearances.

5. A reversible garment according to claim 4 and wherein said garment is a top.

6. A reversible garment according to claim 1 and wherein at least one of said at least three body panels has sides having differing appearances.

7. A reversible garment according to claim 6 and wherein said garment is a top.

8. A reversible garment according to claim 1 and wherein said garment is a top.

* * * * *